US005761579A

United States Patent [19]

Folkins

[11] Patent Number: 5,761,579

[45] Date of Patent: Jun. 2, 1998

[54] FIVE CYCLE COLOR PRINTING ARCHITECTURE WITH TRANSFER AFTER CLEANING

[75] Inventor: Jeffrey J. Folkins, Rochester, N.Y.

[73] Assignee: Xerox Corporation, Stamford, Conn.

[21] Appl. No.: 866,604

[22] Filed: May 30, 1997

[51] Int. Cl.[6] ..... G03G 15/01

[52] U.S. Cl. ..... 399/130; 399/298; 399/343

[58] Field of Search ..... 399/130, 148, 399/147, 178, 223, 344, 298, 343

[56] References Cited

U.S. PATENT DOCUMENTS 5,066,989 11/1991 Yamamoto ..... 399/149
5,574,527 11/1996 Folkins ..... 399/9
5,574,540 11/1996 Folkins ..... 399/171
5,574,541 11/1996 Folkins ..... 399/171
5,576,824 11/1996 Folkins ..... 355/327
5,581,330 12/1996 Pietrowski et al. ..... 355/221

FOREIGN PATENT DOCUMENTS 61-193163 8/1986 Japan .

*Primary Examiner*—Joan H. Pendegrass
*Attorney, Agent, or Firm*—John M. Kelly

[57] ABSTRACT

A five cycle color electrophotographic printing architecture in which the transfer station is located downstream of the cleaning station.

3 Claims, 3 Drawing Sheets

FIVE CYCLE COLOR PRINTING ARCHITECTURE WITH TRANSFER AFTER CLEANING

FIELD OF THE INVENTION

This invention relates to electrophotographic printer architectures.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration so that a desired composite color image results. That composite color image is then transferred and fused onto a substrate.

The REaD IOI process can be implemented in various ways. For example, in a single pass printer wherein the composite final image is produced in a single pass of the photoreceptor through the machine. A second implementation is in a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

Single pass printing is very fast, but expensive since four charging stations and four exposure stations are required. Four pass printing is slower, since four passes of the photoreceptive surface are required, but also much cheaper since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller footprint. Finally, five cycle printing has a decided advantage in that no color image is produced in the same cycle as transfer, fusing, and cleaning when mechanical loads are placed on the drive system.

While electrophotographic printing has been very successful, the rapid growth of the computer industry has created a tremendous demand for desktop printing machines, particularly color desktop printing machines. Desirable features of desktop color printing machines include excellent print quality, high speed printing, low cost, and small size. Those desirable characteristics are difficult to achieve simultaneously using prior art electrophotographic printing machine architectures. Therefore, designers of electrophotographic color marking machines would benefit from new architectures since new architectures would increase their design flexibility to achieve high quality, relatively high speed, and low cost desktop printing machines.

SUMMARY OF THE INVENTION

The present invention provides for 5 cycle electrophotographic color printing architectures in which the transfer station is located downstream of the cleaning station. In one beneficial architecture the order of the electrophotographic printing stations is charging (R), cleaning (C), exposure (E), development (D), and transfer (T).

In another beneficial architecture the order of the electrophotographic printing stations is charging (R), exposure (E), cleaning (C), development (D), and transfer (T).

In yet another beneficial architecture the order of the electrophotographic printing stations is charging (R), exposure (E), development (D), cleaning (C), and transfer (T).

BRIEF DESCRIPTION OF THE DRAWINGS

Other aspects of the present invention will become apparent as the following description proceeds and upon reference to.

DETAILED DESCRIPTION OF PREFERRED EMBODIMENTS OF THE INVENTION

The preferred embodiments of the present invention are electrophotographic printing machines that have system architectures in which the transfer station is downstream of the cleaning station. Each of the preferred embodiments include a plurality of individual subsystems which are known in the prior art, but which are organized and used so as to produce a color image in 5 passes, or cycles, of a photoreceptive member. While 5 cycle color electrophotographic architectures have a 20% loss of productivity over a comparable 4 cycle color electrophotographic architecture, the additional cycle allows for significant size and cost reductions. Furthermore, the principles of the present invention enable significant design flexibility in implementing 5 cycle electrophotographic printing.

Figure 1:
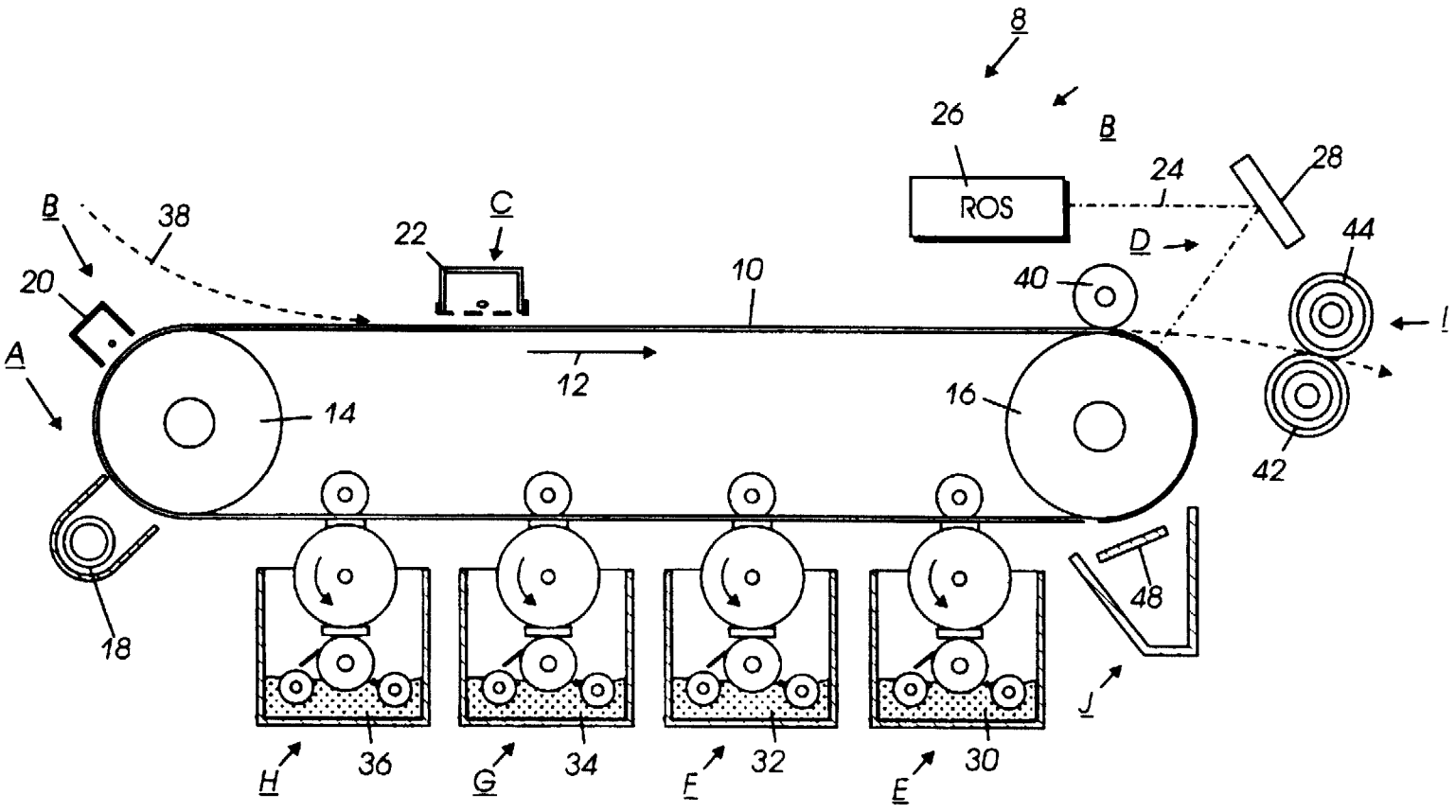
PRIOR ART FIG. 1
FIG. 1 schematically illustrates a prior art electrophotographic printing machine.

As previously indicated the preferred embodiments of the present invention are electrophotographic marking machines, beneficially 5 cycle printing machines, that have novel system architectures. To understand the principles of the present invention it is helpful to understand prior art 5 cycle printing machines. FIG. 1 illustrates a prototypical prior art color electrophotographic, 5 cycle, printing machine 8. The printing machine 8 includes an Active Matrix (AMAT) photoreceptor belt 10 which travels in the direction indicated by the arrow 12. Belt travel is brought about by mounting the belt about a drive roller 16 (which is driven by a motor which is not shown) and a tension roller 14.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas, since each image area is processed in the same way a description of the processing of one image area suffices to fully explain the operation of the printing machine.

As mentioned, the production of a color document takes place in 5 cycles. The first cycle begins with the image area passing through an erase station A. At the erase station an erase lamp 18 illuminates the image area so as to cause any residual charge which might exist on the image area to be discharged. Such erase lamps and their use in erase stations are well known.

As the photoreceptor belt continues its travel the image area passes through a system charging station consisting of a first charging station B and a second charging station C. At the first charging station B a corona generating device 20, beneficially a DC pin scorotron, charges the image area to a relatively high and substantially uniform potential of, for example, about −700 volts. After passing the corona generating device 20 the image area passes through a second charging station C which partially discharges the image area to, for example, about −500 volts. The second charging station C uses an AC scorotron 22 to generate the required ions.

The use of a first charging station to overcharge the image area and a subsequent second charging station to neutralize the overcharge is referred to as split charging. A more complete description of split charging may be found in co-pending and commonly assigned U.S. patent application, "Split Recharge Method and Apparatus for Color Image Formation," Ser. No. 08/347,617. Since split charging is beneficial for recharging a photoreceptor which already has a developed toner layer, and since the image area does not have a toner layer during the first cycle, split charging is not required during the first cycle. If split charging is not used in the first cycle (or in any given cycle) either the corona generating device 20 or the scorotron 22 can be used to charge the image area to the desired level of −500 volts.

Note that the purpose of the charging station is to produce charge on the photoreceptor. The same station can either charge the photoreceptor, if the photoreceptor did not have a previous charge, or recharge the photoreceptor, if it previously had a charge. Therefore, depending on context, charging and recharging are used as alternatives.

After passing through the second charging station C the now charged image area passes through an exposure station D. At the exposure station D the charged image area is exposed to the output 24 of a laser based output scanning device 26 which reflects from a mirror 28. During this first cycle the output 24 illuminates the image area with a light representation of a first black image. That light representation discharges some parts of the image area so as to create an electrostatic latent representation of the exposing light. For example, illuminated sections of the image area might be discharged by the output 24 to about −50 volts. Thus after exposure the image area has a voltage profile comprised of relatively high voltages of about −500 volts and of relatively low voltages of about −50 volts. The −500 volts exists on those parts of the image area which were not illuminated while the −50 volts exists on those parts which were illuminated.

After passing through the exposure station D the exposed image area passes a black development station E which deposits negatively charged black toner 30 onto the image area. The charged black toner adheres to the illuminated image area causing the voltage of the illuminated parts of the image area to be about −200 volts. The non-illuminated parts of the image area remain at −500 volts.

While the black development station E could be a magnetic brush developer, a scavengeless developer may be somewhat better. Scavengeless development is described in U.S. Pat. No. 4,984,019 entitled, "Electrode Wire Cleaning," issued 3 Jan. 1991 to Folkins; in U.S. Pat. No. 4,868,600 entitled "Scavengeless Development Apparatus for Use in Highlight Color Imaging," issued 19 Sep. 1989 to Hayes et al.; in U.S. Pat. No. 5,010,367 entitled "Dual AC Development System for Controlling The Spacing of a Toner Cloud," issued 23 Apr. 1991 to Hays; in U.S. Pat. No. 5,253,016 entitled, "Contaminant Control for Scavengeless Development in a Xerographic Apparatus," issued on 12 Oct. 1993 to Behe et al.; and in U.S. Pat. No. 5,341,197 entitled, "Proper Charging of Doner Roll in Hybrid Development," issued to Folkins et al. on 23 Aug. 1994.

One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development stations (described below) use scavengeless development it may be better to use scavengeless development at each development station.

After passing the black development station E, the image area advances to the first charging station B and the second cycle begins. The first charging station B uses its corona generating device 20 to overcharge the image area and its toner to more negative voltage levels than that which the image area and its first toner layer are to have when they are exposed. For example, the image areas may be charged to a potential 80 of about −700 volts.

At the second charging station C the AC scorotron 22 reduces the negative charge on the image area by applying positive ions so as to charge the image area to about −500 volts. While the average potential of the black toner layer after it passes the second charging station is about −500 volts, individual toner particles will have potentials which vary widely. Since the second charging station supplies positive ions to the black toner layer some of the black toner particles are positively charged. Furthermore, toner particles near the exposed surface of the toner layer tend to be more positively charged than toner particles nearer to the photoreceptor.

An advantage of using an AC scorotron at the second charging station is that it has a high operating slope: a small voltage variation on the image area can result in large charging currents being applied to the image area. Beneficially, the voltage applied to the metallic grid of the AC scorotron 22 can be used to control the voltage at which charging currents are supplied to the image area. A disadvantage of using an AC scorotron is that it, like most other AC operated charging devices, tends to generate more ozone than comparable DC operated charging devices.

After passing through the second charging station C the now substantially uniformly charged image area with its black toner layer advances to the exposure station D. At the exposure station D the recharged image area is exposed to the output 24 of a laser based output scanning device 26. During this cycle the scanning device 26 illuminates the image area with a light representation of the color yellow. That light representation discharges some parts of the image area so as to create a yellow electrostatic latent representation. For example, the non-illuminated parts of the image area have a potential about −500 while illuminated areas are discharged to about −50 volts. It should be understood that individual toner particles will have potentials which vary widely.

After passing the exposure station D the now exposed image area passes a yellow development station F which deposits yellow toner 32 onto the image area. Since the image area already has a black toner layer the yellow development station F should include a scavengeless developer.

After passing the yellow development station F the image area and its two toner layers advance to the first charging station B and the third cycle begins. The first charging station B uses its corona generating device 20 to overcharge the image area and its two toner layers to more negative voltage levels than that which the image area and its two toner layer are to have when they are exposed. The second charging station C again reduces the image area potentials to about −500 volts The substantially uniformly charged image area with its two toner layers then advances again to the exposure station D. At exposure station D the image area is again exposed to the output 24 of the laser based output scanning device 26. During this cycle the scanning device 26 illuminates the image area with a light representation of the color magenta. That light representation discharges some parts of the image area so as to create a magenta electrostatic latent representation.

After passing the exposure station D the third time the image area passes through a magenta development station G. The magenta development station G, preferably a scavengeless developer, advances magenta toner 34 onto the image area. The result is a third toner layer on the image area.

The image area with its three toner layers then advances to the charging station B and the fourth cycle begins. The first charging station B again uses its corona generating device 20 to overcharge the image area (and its three toner layers) to more negative voltage levels than that which the image area is to have when it is exposed (say about −500 volts). The second charging station C again reduces the image area potentials to about −500 volts. The substantially uniformly charged image area with its three toner layers then advances again to the exposure station D. At the exposure station D the recharged image area is again exposed to the output 24 of the laser based output scanning device 26. During this cycle the scanning device 26 illuminates the image area with a light representation of cyan. That light representation discharges some parts of the image area so as to create a cyan electrostatic latent representation. After passing the exposure station D the image area passes a cyan development station H. The cyan development station, also a scavengeless developer, advances a cyan toner 36 onto the image area.

After passing the cyan development station the image area has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it becomes necessary to prepare the charges on the toner layer for transfer.

The fifth cycle begins by passing the image area through the erase station A. At erase station A the erase lamp 18 discharges the image area to a relatively low voltage level. This reduces the potentials of the image area, including that of the composite color powder image, to near zero. The image area then passes to the charging station B. During this fifth cycle the charging station B performs a pre-transfer charging function by supplying sufficient negative ions to the image area that substantially all of the previously positively charged toner particles are reversed in polarity.

As the image area advances a substrate 38 is placed over the image area using a sheet feeder (which is not shown). As the image area and substrate continue their travel they pass the charging station C.

At charging station C the second charging device 22 applies positive ions onto the substrate 38. The positive ions attract the negatively charged toner particles onto the substrate. As the substrate continues its travel the substrate passes a bias transfer roll 40 which assists in attracting the toner particles to the substrate and in separating the substrate with its composite color powder image from the photoreceptor belt 10. The substrate is then directed into a fuser station I where a heated fuser roll 42 and a pressure roller 44 create a nip through which the substrate passes. The combination of pressure and heat at the nip causes the composite color toner image to fuse into the substrate 38. After fusing, a chute, not shown, guides the support sheets 38 to a catch tray, also not shown, for removal by an operator.

After the substrate is separated from the photoreceptor belt 10 the image area continues its travel and eventually enters a cleaning station J. At cleaning station J a cleaning blade 48 is brought into contact with the image area. That blade wipes residual toner particles from the image area. The image area then passes once again to the erase station A and the 5 cycle printing process begins again.

Using well known technology the various machine functions described above are generally managed and regulated by a controller which provides electrical command signals for controlling the operations described above.

Figure 2:
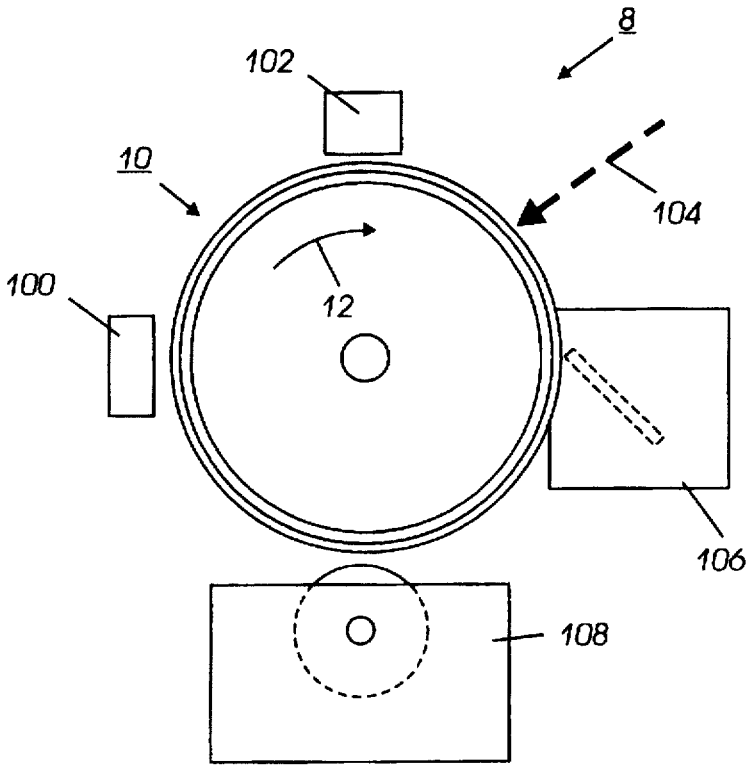
PRIOR ART FIG.2
FIG. 2 illustrates the relative locations of various stations in the prior art printing machine of FIG. 1.

With an understanding of the various stations described above the principles of the present invention can be more easily understood. FIG. 2 shows a highly simplified version of the printing machine 8 with the various processing stations arranged in order around a photoreceptor 10, which is now shown as a circular member. Referring to FIG. 2, the photoreceptor rotates in the direction 12. Beginning at the charging station, which includes the first charging station B and the second charging station C, and following the direction 12, the various stations are physically located in the order charge 100 (R), transfer 102 (T), Expose 104 (E), clean 106 (C), and develop 108 (D). The direction 12 and the charging station define downstream directions and upstream direction wherein a station that is physically closer to the charging station when moving in the direction 12 is upstream while a station that is physically farther away from the charging station when moving in the direction 12 is downstream. In a shorthand format the order of the stations in the printing machine 8 can be given as RTECD. That order, while beneficial in that the developers can all be located below the photoreceptor 10 (as in FIG. 1), may not be optimal. It seriously constrains designers of 5 cycle electrophotographic marking machines to a single architecture that may not be optimal in a given application.

Figure 3:
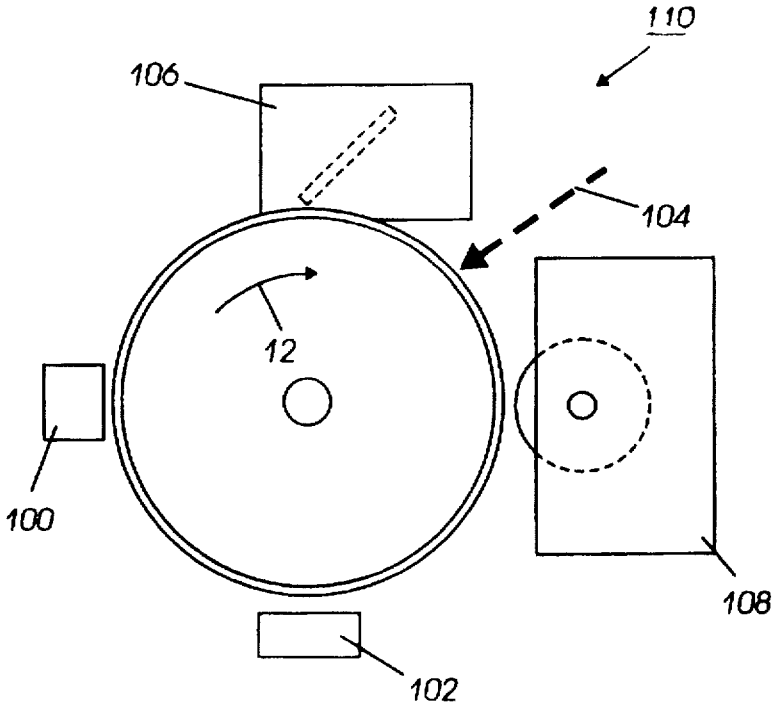
FIG. 3 illustrates the relative locations of various stations in a first embodiment of a 5 cycle electrophotographic printing machine that is in accord with the principles of the present invention.

The principles of the present invention provide for alternative architectures in which the cleaning station is located upstream of the transfer station. That is, the cleaning station is located physically nearer to the charging station than the transfer station, with distance being measured along the direction 12. A first preferred embodiment of the present invention is provided in FIG. 3. FIG. 3 shows an electrophotographic printing machine 110 in which the various stations are located in the order re-charge 100 (R), clean 106 (C), expose 104 (E), develop 108 (D), and transfer 102 (T). In a shorthand format that order can be given as RCEDT. For example, this architecture allows for the conventional placement of development at the 3 O'clock position and transfer at the 6 O'clock position, and thus enables more commonality with conventional 4 cycle machines.

It is to be understood that with the various architectures that the transfer step can occur at the end of cycle 4 rather than at the beginning of cycle 5 (as in printing machine 8), but that the temporal sequence is invariant.

Figure 4:
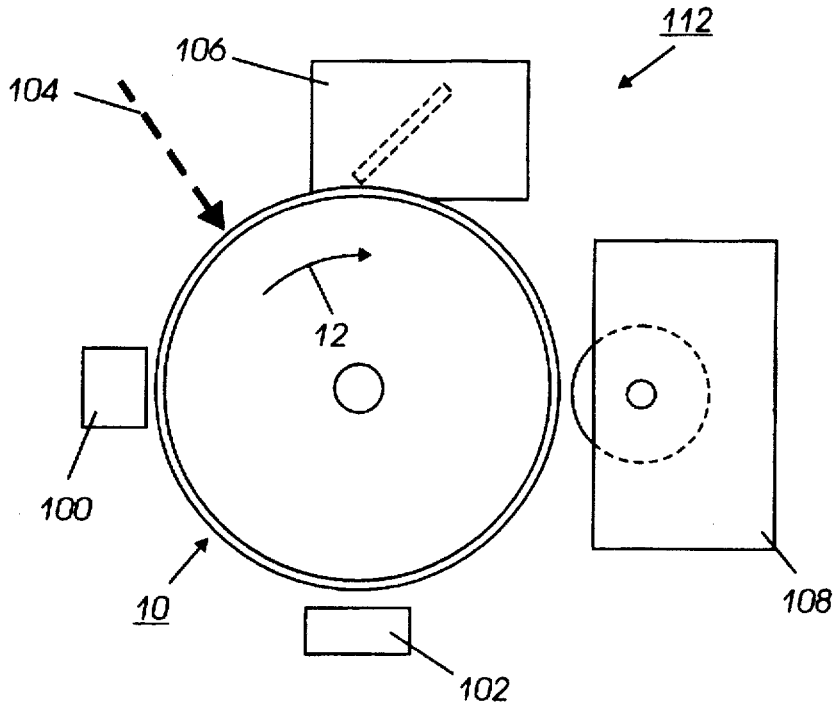
FIG. 4 illustrates the relative locations of various stations in a second embodiment of a 5 cycle electrophotographic printing machine that is in accord with the principles of the present invention.

A second preferred embodiment of the present invention is provided in FIG. 4. FIG. 4 shows an electrophotographic printing machine 112 in which the various stations are located in the order re-charge 100 (R), expose 104 (E), clean 106 (C), develop 108 (D), and transfer 102 (T). In a shorthand format that order can be given as RECDT.

Figure 5:
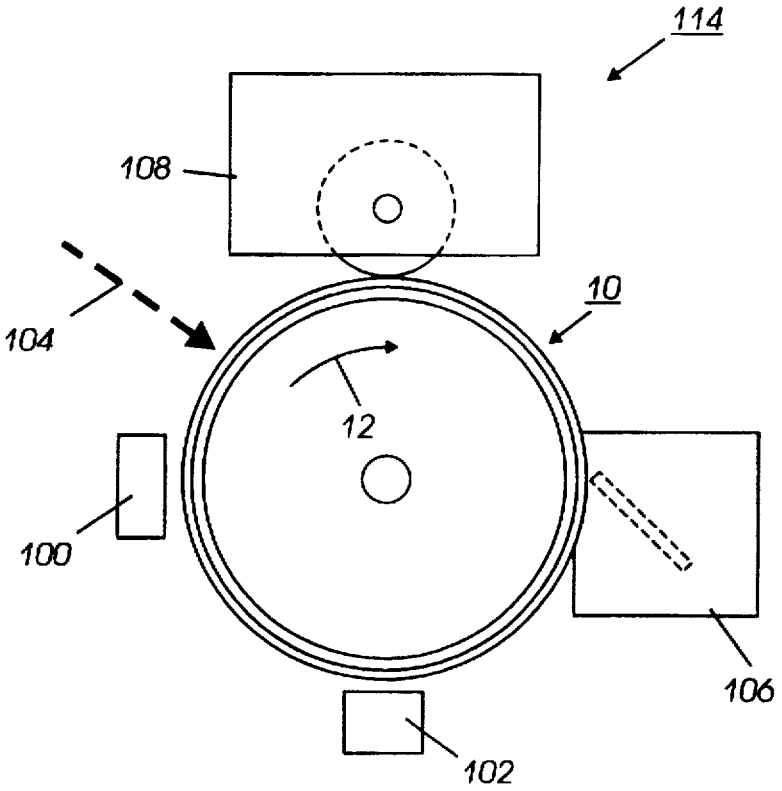
FIG. 5 illustrates the relative locations of various stations in a third embodiment of a 5 cycle electrophotographic printing machine that is in accord with the principles of the present invention.

A third preferred embodiment of the present invention is provided in FIG. 5. FIG. 5 shows an electrophotographic printing machine 114 in which the various stations are located in the order re-charge 100 (R), expose 104 (E), develop 108 (D), clean 106 (C), and transfer 102 (T). In a shorthand format that order can be given as REDCT.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A color marking machine which produces a composite color image in five cycles of a photoreceptive member, said color marking machine comprised of:

a continuous photoreceptive member;

a drive system rotating said photoreceptive member in a first direction;

a charging station (R) for charging said photoreceptive member;

an exposure station (E) for exposing said photoreceptive member so as to produce latent images on said photoreceptive member;

a development station (D) for developing said latent images with toner to produce a toner image on said photoreceptive member;

a transfer station (T) for transferring said toner image from said photoreceptive member onto a substrate; and a cleaning station (C) for removing residual toner particles from said photoreceptive member;

wherein said transfer station (T) is located downstream of said cleaning station (C); and wherein said charging station (R), said exposure station (E), said development station (D), said transfer station (T), and said cleaning station (C) are in the order of RCEDT.

2. A color marking machine according to claim 1, wherein said development station includes developers for multiple colors of toner.

3. A color marking machine according to claim 2, wherein said development station includes developers for black toner, yellow toner, magenta toner, and cyan toner.

* * * * *